US005788850A

United States Patent [19]

Tuomey

[11] Patent Number: 5,788,850

[45] Date of Patent: Aug. 4, 1998

[54] POOL SURFACE SWEEP SYSTEM

[76] Inventor: Scott D. Tuomey, 5012 Lovell Ave., Fort Worth, Tex. 76107

[21] Appl. No.: 646,932

[22] Filed: May 8, 1996

[51] Int. Cl.[6] ..... E04H 3/20

[52] U.S. Cl. ..... 210/169; 210/242.1; 134/168 R; 4/490

[58] Field of Search ..... 210/169, 242.1; 134/167 R, 168 R; 4/490

[56] References Cited

U.S. PATENT DOCUMENTS

| | | | |
|---|---|---|---|
| 2,991,587 | 7/1961 | Blanchard | 46/95 |
| 3,237,343 | 3/1966 | Blanchard | 46/95 |
| 3,972,339 | 8/1976 | Henkin et al. | 210/169 |
| 4,040,864 | 8/1977 | Steeves | 134/6 |
| 4,114,206 | 9/1978 | Franc | 134/167 R |
| 4,589,986 | 5/1986 | Greskovics et al. | 210/169 |
| 4,640,784 | 2/1987 | Cant | 210/169 |
| 4,746,424 | 5/1988 | Drew | 210/169 |
| 4,889,622 | 12/1989 | Newcombe-Bond | 210/169 |
| 4,900,432 | 2/1990 | Arnold et al. | 210/91 |
| 5,106,492 | 4/1992 | Distinti et al. | 210/91 |
| 5,128,031 | 7/1992 | Midkiff | 210/109 |
| 5,392,574 | 2/1995 | Maxfield | 4/490 |

OTHER PUBLICATIONS

Lifeguard Hydro–Skim 1994.

*Primary Examiner*—Thomas G. Wyse
*Attorney, Agent, or Firm*—Geoffrey A. Mantooth

[57] ABSTRACT

A system for sweeping a surface of a body of water includes a sweep, water supply lines and a controller. The sweep has a basket that is interposed between two lateral floats. There is also a float located rearwardly of the basket. The floats are coupled to the basket by way of a housing or frame. The water supply lines extend through the housing, down through the lateral floats and out to rearwardly facing nozzles. The water supply lines extend out a rear end of the housing to the controller. The controller is connected to a source of pressurized water. The controller has two valves, one valve for each water supply line. By alternately opening and closing the individual valves, the flow of pressurized water to the individual nozzles can be controlled, thereby steering the sweep as it is propelled along the surface of the pool. In another embodiment, the sweep can be automatically propelled, wherein a backup valve is provided. The backup valve alternates between providing forward propulsion and rear or back propulsion. An extension is mounted on the front end of the automatic sweep to cause the sweep to sweep along a side wall of a pool.

10 Claims, 7 Drawing Sheets

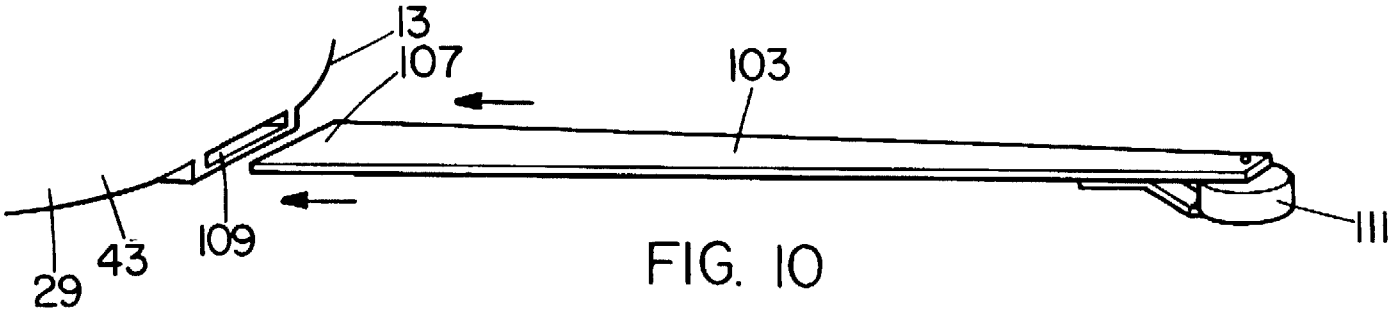
FIG. 10
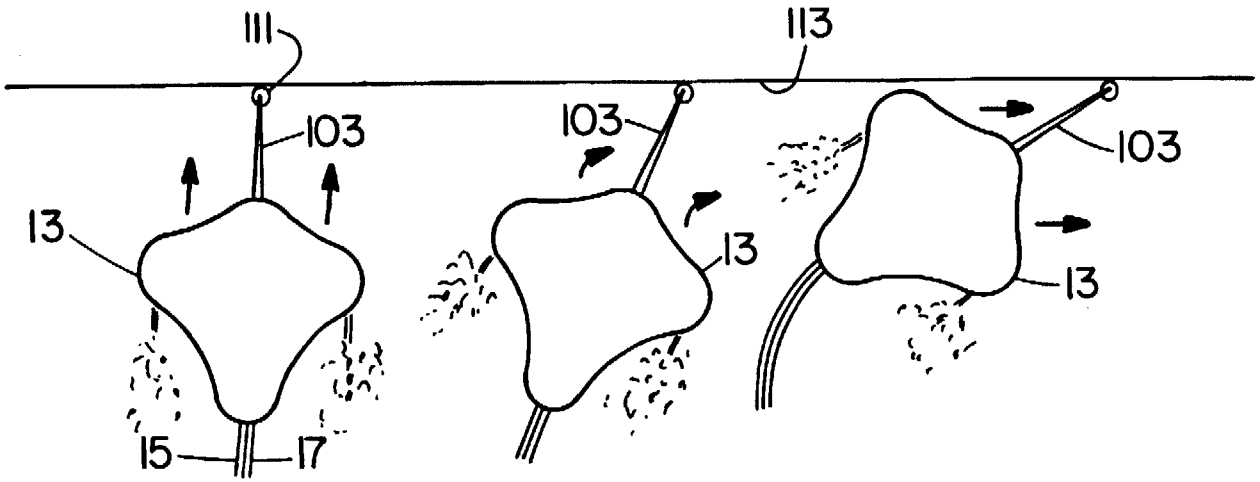
FIG. 11A
FIG. 11B
FIG. 11C

POOL SURFACE SWEEP SYSTEM

FIELD OF THE INVENTION

The present invention relates to apparatuses for cleaning debris from the surface of pools of water, such as for use in swimming pools.

BACKGROUND OF THE INVENTION

Swimming pools are much akin to natural bodies of water, such as ponds. Both can accumulate debris that clouds the water. What makes swimming pools different from natural bodies of water is, among other things, that the water in swimming pools is chemically treated and constantly cleaned. If the water in a pool is not cleaned, then after a short period time, the water in the pool begins to look like water in a pond. Algae begins to grow and the water may cloud.

In order to maintain the pool, debris in the pool must be removed by frequent cleaning. In the prior art, there are may devices for removing debris from the swimming pools. One such device is known by the name "Polaris". This device moves along the bottom surface of the pool on wheels. The wheels are connected to a gear box, wherein the wheels are rotated. In addition, one or more water jets are exhausted out of the device. Another such device is known by the name "Creepy Crawler". This device uses a vacuum drive to move along the bottom surface of a pool. Both of these devices are randomly steered and cannot be manually steered. Still another device has wheels on the bottom and on the sides and is known by the name "Ray Vac". This device is diamond shaped and moves randomly by water jets.

Still another prior art device is known as "Aqua King". This device moves along the bottom surface of a pool on treads. It can be manually steered by way of electrical wires that extend from the device to an operator on the surface.

There are also prior art surface skimmers that are either tethered to a side of the pool, or else randomly roam the surface of the pool, skimming debris off of the top of the water.

There is also in the prior art a hand net mounted to end of a pole. An operator scoops debris out of the pool with the net, using the pole to extend the net towards the middle of the pool. Such repetitive motion of moving the net can cause pain and discomfort in the operator's wrists and arms. Also, nets simply cannot reach the middle of wide pools. Also, netting a large pool is time consuming. In addition, the movement of the net through the water causes turbulence which causes some floating debris to sink to the bottom, where retrieval is more difficult.

SUMMARY OF THE INVENTION

It is an object of the present invention to provide a self propelled apparatus for sweeping the surface of the pool.

It is another object of the present invention to provide an apparatus for sweeping the surface of a pool, which apparatus is steerable.

The system of the present invention sweeps a surface of a body of water. The system includes a sweep, conduits, and a controller. The sweep includes a basket, floats, and nozzles. The basket has a front opening and a mesh that extends rearwardly from the front opening. The floats are coupled to the basket and have a buoyancy that positions the front opening of the basket above and below the surface of the water. The basket is partially submerged in water. The two nozzles are coupled to the basket, with each of the nozzles having an opening that faces rearwardly relative to the basket front opening. The nozzles are spaced apart from each other with the basket being located between the nozzles. The two conduits each have first and second ends. The first end of each conduit is connected to a respective one of the nozzles. The second end of each conduit is connected to the controller. The controller is connected to a pressurized supply of fluid. The controller is operable so as to selectively control the pressurized fluid to each of the conduits such that the basket can be steered as it is propelled across the water.

In accordance with one aspect of the invention, the basket is provided with a pivotable door that acts as a trap door to trap debris inside the basket and prevent its escape.

In accordance with another aspect of the present invention, the floats include two lateral floats that are spaced apart from each other with the basket being located therebetween. The nozzles are located in the respective lateral floats. In accordance with still another aspect of the present invention, there is provided a rear float located relative to the basket.

In still another aspect of the invention, the conduits are flexible and buoyant so as to float on the water. Thus, the conduits do not inhibit movement of the basket.

In still another aspect of the invention, the basket depends from a frame. The floats also depends from the frame. The frame has rounded sides and a rounded front end.

With the sweep system of the present invention, the surface of a pool can be cleaned easily and quickly. The sweep is merely positioned on top of the water. Pressurized water exhausted through the nozzles propel the sweep in a forward direction. The controller allows an operator to steer the sweep. The operator can be standing on the side of the pool or sitting comfortably in a chair. The sweep can be steered to clean up particular patches of debris or the sweep can be steered to clean the entire surface area of the pool. The sweep is light weight and is highly manueverable due to the nozzles being located at the ends of the basket.

In still another aspect of the present invention, a backup valve is used instead of a manual controller. Use of the backup valve allows the sweep to be automatically operated. The sweep is connected to a source of pressurized water by way of the backup valve. The backup valve, which is located behind the basket, operates in an alternating manner between a first stage and a second stage. In the first stage, pressurized water passes through the backup valve to the nozzles of the sweep. The sweep is thus propelled in a forward direction. In its second stage, the backup valve vents the pressurized water out of its forward end. This provides backing thrust, wherein the backup valve and the sweep are propelled in a backwards or reverse direction. The backup valve pulls the sweep to a new heading, wherein when the sweep commences moving in a forward direction again, it travels on the new heading. In this manner, the entire surface area of the pool can be cleaned over a period of several hours.

In still another aspect of the present invention, the automatically operated sweep is provided with an extension extending out of the front end. The free end of the extension has a roller that rotates about a vertical axis. As the sweep contacts a side wall of the pool, the sweep pivots about the roller. The extension with the roller allows the sweep to sweep along side the side wall of the pool. The sweep therefore is not stuck in a "face the wall" position, wherein the basket opening faces the pool wall. In many instances, the wind blows a large amount of debris along the side wall of the pool. The use of the extension allows the sweep to collect all of this debris.

BRIEF DESCRIPTION OF THE DRAWINGS

FIG. 10 is a side perspective view of an extension for use with the sweep system of FIG. 8.

FIGS. 11A, 11B, and 11C illustrate the operation of the sweep system with the extension of FIG. 10.

DESCRIPTION OF THE PREFERRED EMBODIMENTS

Figure 1:
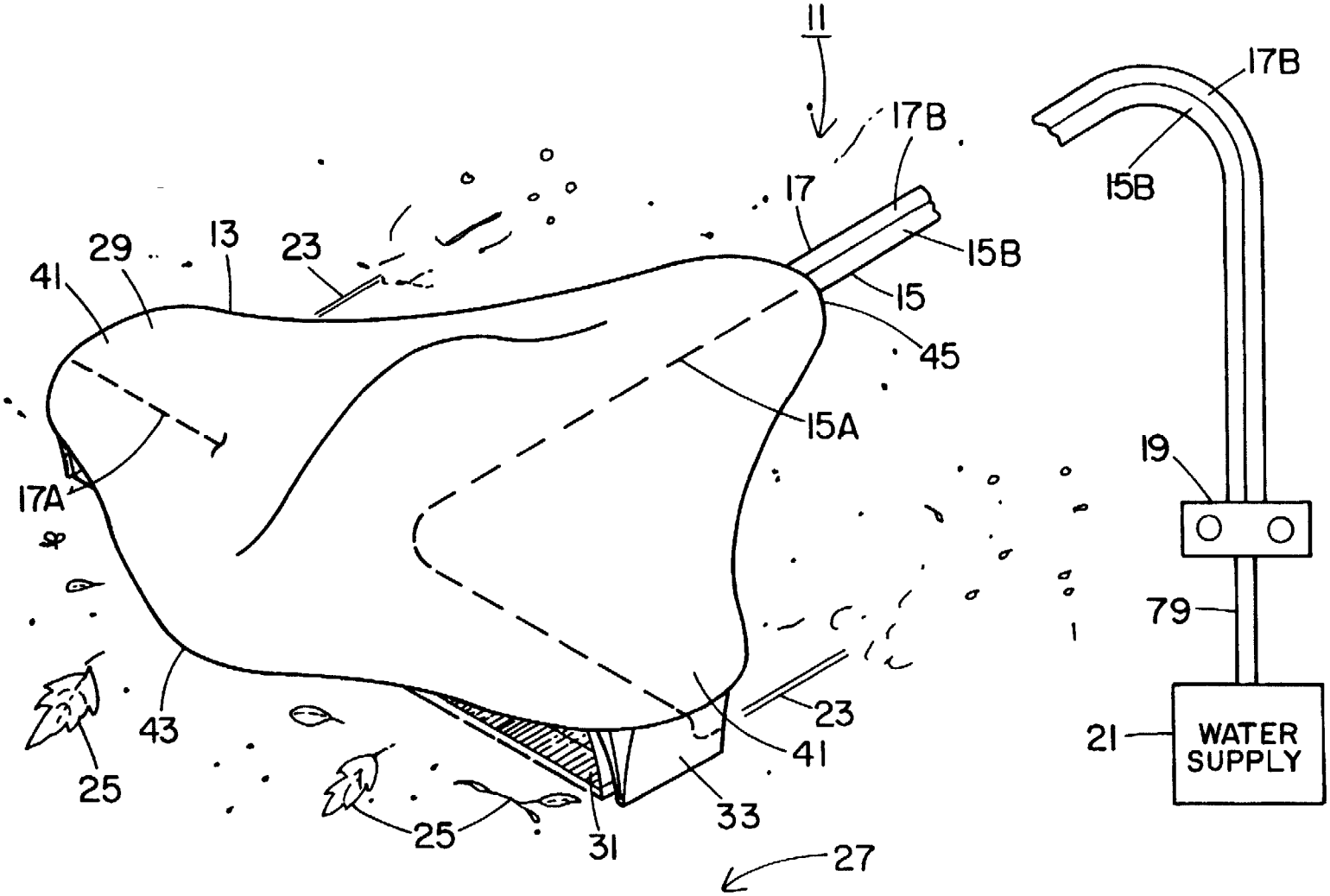
FIG. 1 is an isometric and schematic view of the pool surface sweep system of the present invention, in accordance with a preferred embodiment.

In FIG. 1, there is shown the pool surface sweep system 11 of the present invention, in accordance with a preferred embodiment. The sweep system 11 is used to clean floating debris 25 (such as leaves) from the surface of a swimming pool 27, or other body of water.

The sweep system 11 includes a sweep 13, water supply lines 15, 17 and a controller 19. (In FIG. 1, the sweep 13 is shown in a larger scale than are the other elements.) The water supply lines 15, 17 connect the controller 19 to the sweep 13. The controller 19 is also connected to a source 21 of pressurized water. The sweep 13, which floats on the water, is propelled across the surface of the water by jets 23 of water. The controller 19 is typically held by a human standing on the side of the pool. The controller 19 is used to steer the sweep 13 across the surface of the water.

Thus, with the present invention, the sweep 13 can be moved across the surface of the pool, sweeping floating debris 25. The human operator can steer the sweep 13 so as to sweep up of particular patches of debris. Also, the operator can steer the sweep to sweep the entire surface area of the pool. The jet propulsion enables the sweep to be moved quickly and to be highly maneuverable on the water.

The sweep system 11 will now be described more specifically, beginning the sweep 13 itself.

Referring to FIGS. 2–5, the sweep 13 includes a housing 29, a basket 31, floats 33 and water nozzles 35. The housing 29 has a bottom wall 37, a top wall 39 and an interior cavity (not shown) therebetween.

The bottom wall 37 is relatively rigid and forms a frame to support the basket 31, the floats 33, and the lines 15, 17. The housing 29 has sides 41, a front end 43, and a rear end 45. The top wall is also rigid. In the preferred embodiment, the top wall can be removed from the bottom wall to provide access to the cavity. Also, the cavity is filled with plastic foam.

In the preferred embodiment, the housing 29 is shaped like a manta ray fish. This shape is aesthetically pleasing, as well as provides low air resistance as the sweep moves across the surface of the water. In addition, the rounded front end 43 and sides 41 of the housing 29 enable the sweep to deflect off of floating objects or the side walls of the pool. The housing 29 can be any number of shapes however.

The basket 31 has an elongated front opening 47. A mesh 49 extends rearwardly from the front opening. The mesh 49 can be rigid or flexible. (If the mesh is flexible, then rigid members are used to define the front opening 47.) The mesh is sized so that water passes through while debris is retained inside of the basket. In the pool industry, various size meshes are used in nets and filters. The present invention uses a mesh size found in pumps. Such a mesh is found in a rigid basket that is located upstream of the pump. This size mesh traps large debris such as leaves, grass, and trash. Dirt particles pass through the mesh. A finer size mesh could be used to trap smaller objects. The basket 31 is coupled to the under side of the bottom wall 37, such that the basket depends from the bottom wall. In the preferred embodiment, the mesh is rigid so as to simplify the coupling of the basket to the bottom wall. The basket is generally rectangular in shape.

Figure 5:
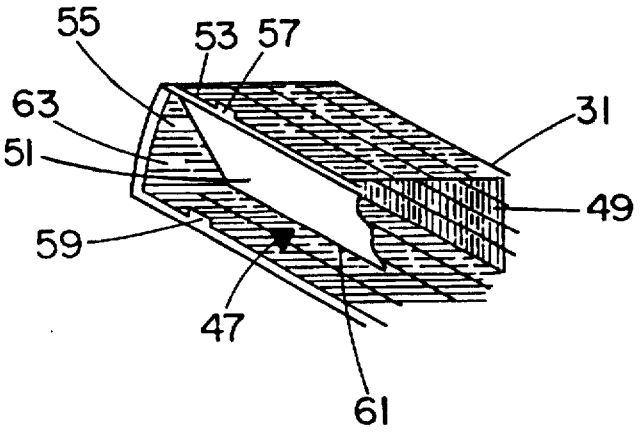
FIG. 5 is a detailed view of the basket, showing a trap door installed therein.
Figure 3:
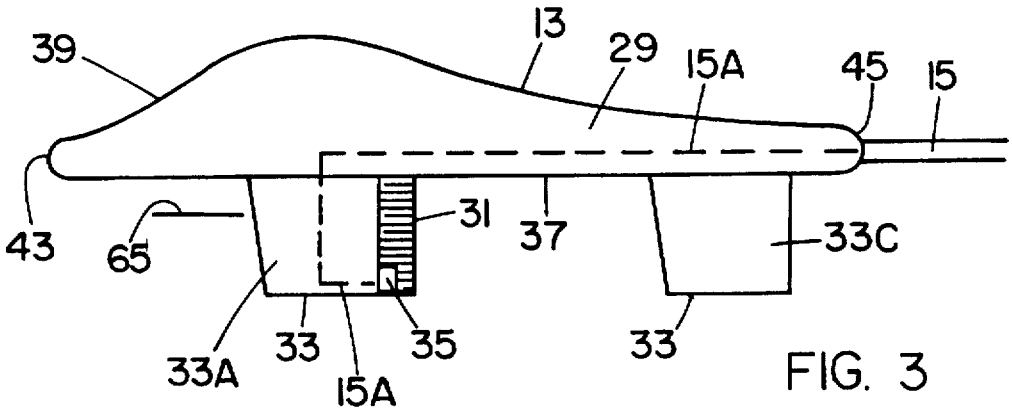
FIG. 3 is a side view of the sweep.
Figure 4:
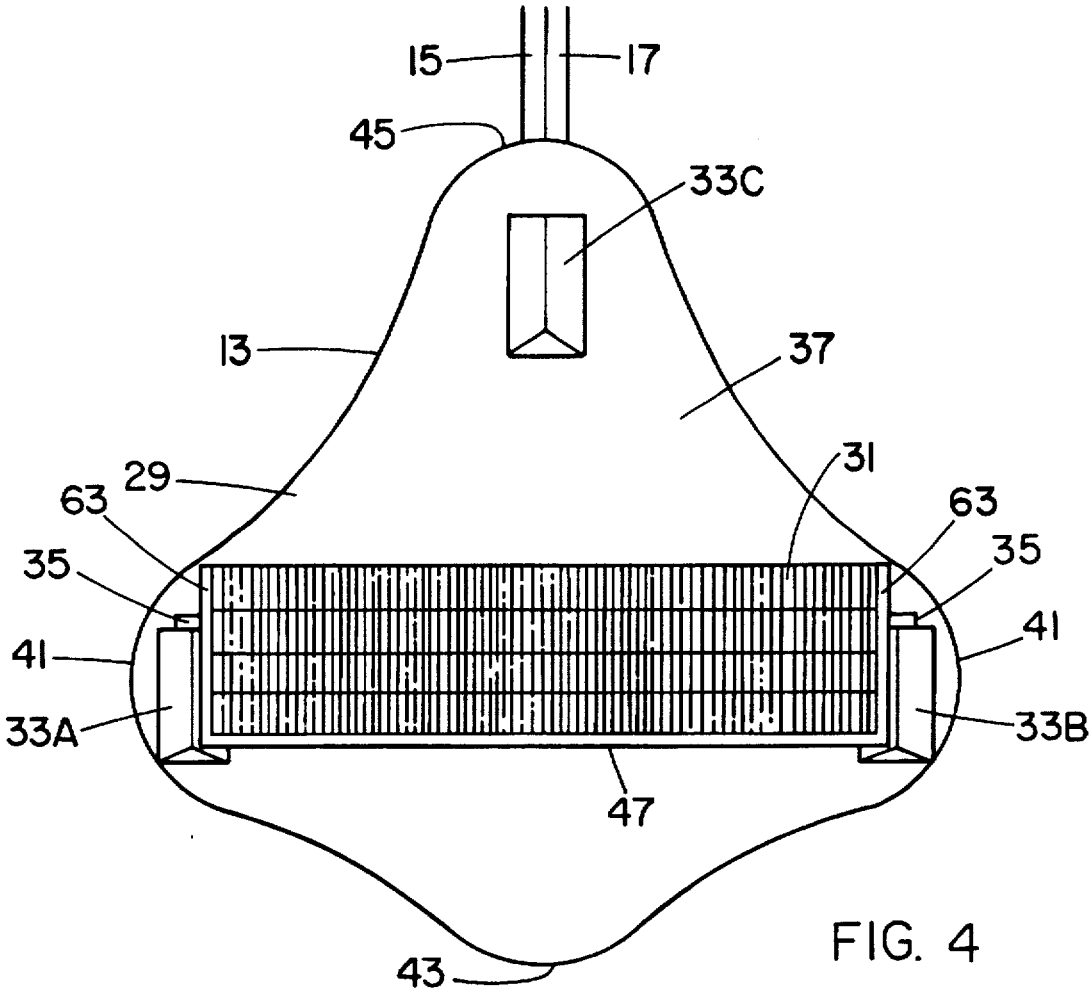
FIG. 4 is a bottom view of sweep.

The basket 31 is provided with a trap door 51 at the front opening 47 (see FIG. 5). The trap door 51 allows debris to enter the basket 31 by way of the front opening, but inhibits debris from exiting by the same opening. The trap door 51 is connected to the upper portion of the basket so as to depend down and close off the front opening 47. The trap door is pivotally coupled to the basket. This can be accomplished by hinges 57 on the upper edge of the trap door that are coupled to the upper wall 53 of the basket. Alternatively, pins (not shown) on each of the ends of the trap door can be received at the upper portion of the respective side walls 55 of the basket. Stops 59 are provided at the bottom of the front opening 47 so as to prevent the trap door from pivoting outside of the basket. The bottom edge 61 of the trap door 51 swings freely with respect to the basket.

The sweep 13 also has floats 33 to keep the sweep floating on the water. The floats 33 depend from the bottom wall 37 of the housing 29. In the preferred embodiment, there are three floats, namely two forward floats 33A, 33B (a left float and a right float) and one rear float 33C. The two forward floats 33A, 33B are located at either end 63 of the basket 31. Thus, the basket 31 is interposed between the forward floats 33A, 33B. The rear float 33C is located along the fore-aft centerline of the sweep 13 and rearwardly of the basket 31 (see FIG. 4).

Figure 2:
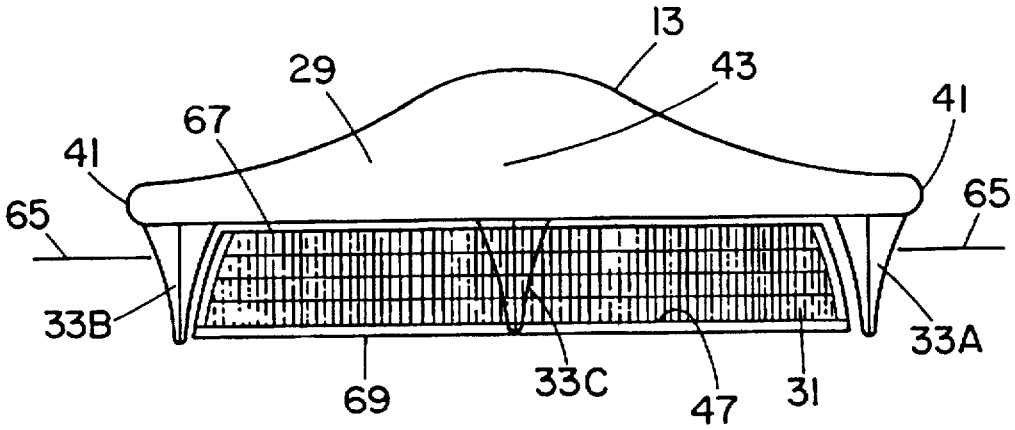
FIG. 2 is a front view of the pool surface sweep.

Each float 33 is made of a rigid plastic shell, the interior of which is filled with plastic foam to provide buoyancy. The floats are sized and shaped so as to locate the front opening 47 of the basket 31 both above and below the surface 65 of the water, as shown in FIG. 2. In the preferred embodiment, the top edge 67 of the front opening 47 should be about 1–2 inches above the surface 65 of the water. The upper one third of the front opening is located above the water surface 65, while the bottom two thirds of the front opening is located below the water surface. However, the basket can be set at any desirable depth. In general, the deeper the bottom edge 69 of the front opening 47 is, the less turbulence that will be created by the passage of the sweep.

The floats 33 can be shaped as shown in drawings, so as to minimize resistance through the water. However, if the sweep 13 is light relative to the force of water propelling the sweep along, then water resistance may not be a factor and the floats can be a variety of shapes, even blocks.

There are two water supply lines, namely a left line 15 and a right line 17 (see FIG. 1). Inside the sweep 13 itself, the lines are plastic tubing 15A, 17A. Each line 15A, 17A extends through the housing 29, beginning at the rear end 45 of the sweep and traversing towards the front end 43 of the housing (in FIG. 1, the lines 15A, 17A are shown as dashed lines). Each line 15A, 17A then traverses towards the respective side 41 of the housing, wherein each line then descends into the respective float 33 where it connects to a nozzle 35 (see FIG. 3).

Each nozzle 35 is located on the rear side (relative to the front end 43) of the respective float 33. Thus, fluid 23 (see FIG. 1) exiting the nozzle is directed rearwardly, wherein the sweep 13 is pushed forward. Each nozzle 35 presents a reduced inside diameter with respect to the connecting line 15A, 17A. For example, in the preferred embodiment, the inside diameter of the nozzle 35 is ⅓–½ the size of the connecting line 15A, 17A. The left line 15A provides fluid to the nozzle in the left float 33A, while the right line 17A provides fluid to the nozzle in the right float 33B.

At the rear end 45 of the housing 29 are connectors (not shown). The connectors couple the water supply lines 15A, 17A that are located inside of the housing to water supply lines 15B, 17B located outside of the housing. The water supply lines 15B, 17B located outside of the housing are hoses that are preferably fused or otherwise coupled together. However, the hoses need not be coupled together. It is preferable that the hoses float or have neutral buoyancy so as to minimize interference with the movement of the sweep along the surface of the water.

The hoses 15B, 17B extend from the rear end 45 of the sweep housing 29 to the controller 19. The controller 19 is shown in more detail in FIG. 6. The controller 19 is designed to be hand held for manual operation. The controller has a body 72, which body has an inlet passage 73 and two outlet passages 75, 77 (left and right outlet passages). Each of the outlet passages 75, 77 communicate with the inlet passage 73. One end of a water inlet hose 79 is connected to the inlet passage 73 by way of a conventional hose connection. The other end of the water inlet hose 79 is connected to the water supply 21 (see FIG. 1). The left and right hoses 15B, 17B are connected to the respective left and right outlet passages 75, 77.

Figure 7:
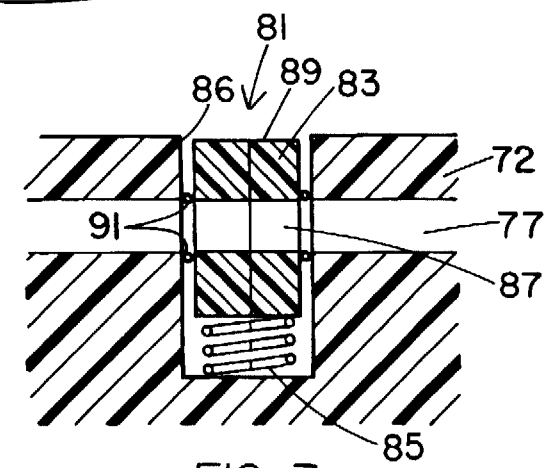
FIG. 7 is cross-sectional view of one of the valves of the controller of FIG. 6, taken through lines VII—VII.

Each outlet passage 75, 77 contains a shut-off valve 81 for opening and closing the outlet passage. Referring to FIG. 7, there is shown a cross-sectional view of one of the valves 81. Each valve 81 includes a cylinder 83 and a spring 85. The cylinder 83 is received by a bore 86 in the controller body 72, which bore intersects the respective outlet passage 75, 77. The cylinder 83 has a passage 87 extending radially therethrough. When the cylinder 83 is located in the bore 86, the cylinder passage 87 is aligned with the respective outlet passage 75, 77. The valve 81 is normally open, wherein the cylinder passage is normally aligned with the respective outlet passage. The top of the cylinder 83 forms a button 89 which the operator can press. When the cylinder is pressed further into the bore, it moves to the closed position, wherein the passage 87 is below the respective outlet passage 75, 77. This cuts off water flow through the valve 81. O-rings 91 are provided to seal around the cylinder. The spring 85 is provided in the bore 86 below the cylinder to return the cylinder to the normally open position when the cylinder is no longer pressed. Rotation of the cylinder can be prevented by way of a spline and keyway (not shown) between the cylinder and the bore.

Figure 6:
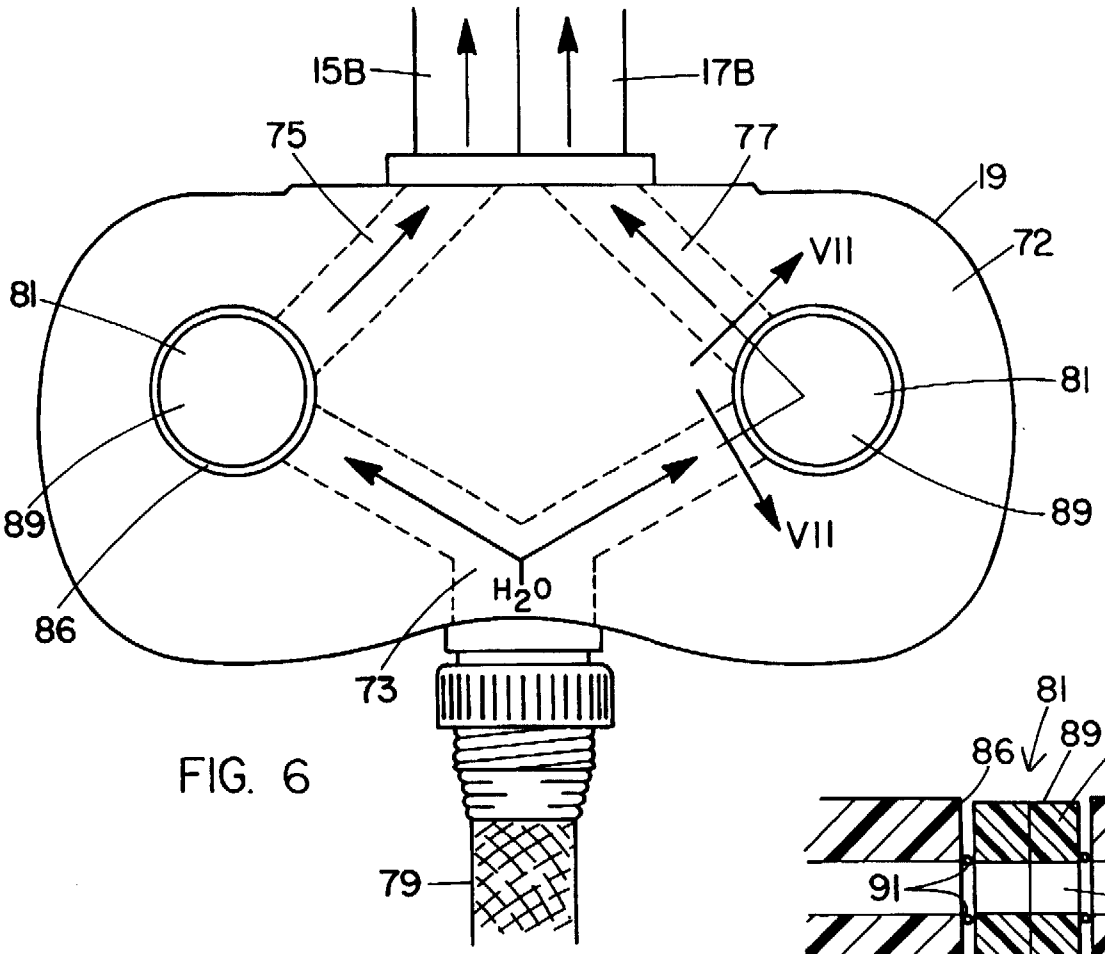
FIG. 6 is a plan view of a manual controller used in the sweep system of the present invention.

The controller is shaped, in plan view as shown in FIG. 6, in the general shape of a rectangle, with rounded comers. The inlet and outlet hoses 15B, 17B are centered. However, the buttons 89 are offset. The operator grasps the controller 19 in the palm of each hand, with the fingers gripping the bottom side of the controller and the two thumbs contacting the buttons 89. Thus, the right thumb contacts the right button and the left thumb contacts the left button (left and right are in reference to the orientation of the controller shown in FIG. 6).

The operation of the sweep system 11 will now be described. First, the system is set up for operation. The sweep is located on the surface of the pool of water. Also, the inlet hose 79 to the controller is connected to a source 21 of pressurized water. For example, an outdoor water faucet can be used, which faucet is connected to a water supply of a building. It is desired that the water pressure be adequate to propel the sweep quickly. For example, in the preferred embodiment, the water pressure of the building water supply is about 60–70 lbs. per square inch. Another source of pressurized water is the pump used to circulate water in the pool. A connection can be made to the output of the pool pump in several locations. One location is under water in the pool itself. Typically, one or more water returns are located in a side wall of the pool. Each return delivers pressurized water from the pump back into the pool. The inlet hose can be attached to one of these returns (see FIG. 8). Alternatively, a fitting can installed in the return pipe exiting from the pool pump. Typically, this fitting would be down stream of any filtration device. Such a fitting provides a connection that is dry and located out of the pool water. A valve can be placed in the return pipe (downstream from the fitting) in order to divert water flow into the inlet hose 79. Still another source of pressurized water is from a dedicated pump. A dedicated pump can be plumbed from the filtration complex to the pool wall. Frequently, a pool maybe equipped with a bottom sweep pump. This pump can be used to operate the surface sweep of the present invention. Alternatively, a dedicated pump can be located on the side of the pool. This pump has a hose located in the pool water which is connected to the inlet of the pump. The sweep inlet hose 79 is connected to the outlet of the pump.

After the sweep system has been set up, it is ready for operation. The operate, pressurized water is provided by the source 21. (This may necessitate the opening of a valve, such as the water faucet valve.) The pressurized water flows though the hose 79, the controller 19, and the lines 15–17 to exit the nozzles 33. The sweep 13 is thus pushed forward across the surface of the pool.

The sweep 13 approaches and then traps floating debris 25 in the basket 31. Debris enters the basket through the front opening 47. The trap door 51 and the forward motion of the sweep prevent the debris from exiting the basket 31.

The sweep 13 is steered by the controller 19. To turn the sweep to the right, the right button 89 (see FIG. 6) on the controller 19 is pressed, while leaving the left button in its up position. This action reduces the flow of water out of the right nozzle on the sweep. The sweep 13 thus turns to the right due to water exiting the left nozzle. Likewise, a left turn is effected by pressing the left button and keeping the right button up.

To turn the sweep 13 sharply, the respective button is depressed entirely to cut off all water flow into the respective outlet passage of the controller 19. To turn the sweep more slowly, the respective button is only partially depressed so as to allow some water flow in the respective outlet passage.

Because the nozzles are spaced well apart from the center line of the sweep 13, the sweep is highly maneuverable and can effect sharp turns.

To stop the sweep, both the right and left buttons 89 are pressed simultaneously. All pressurized water is cut off from the sweep and the sweep stops for lack of propulsion. To slowly propel the sweep forward, both buttons are partially depressed.

Although the controller has been described as having the valves in the normally open position, a controller having its valves in the normally closed position could also be utilized. Actuation of the valves would allow pressurized water to flow through the controller into the sweep. Also, the valves can actuated in a variety of manners and need not be limited to buttons.

Figure 8:
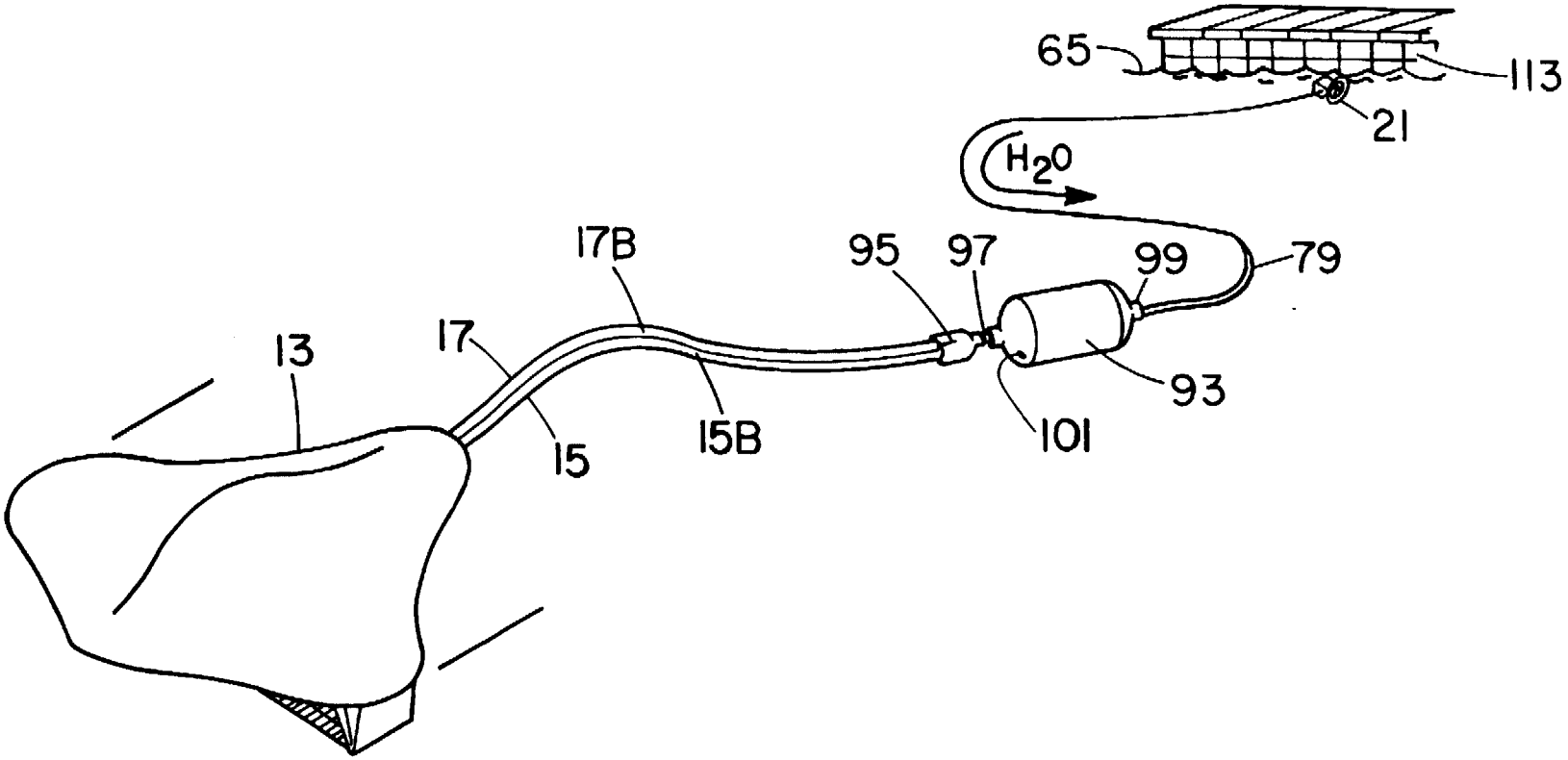
FIG. 8 is an isometric of the pool surface sweep system in accordance with another embodiment.

The sweep can also be automatically steered in a random manner. FIG. 8 shows the sweep used with a backup valve 93. The two water hoses 15B, 17B extend from the rear end 45 of the sweep 13 and connect to the outlets of a hose splitter 95. The inlet of the hose splitter 95 is connected to an outlet 97 of the backup valve. The backup valve 93 is located a short distance behind the sweep. In fact, the backup valve can be incorporated into the rear end 45 of the housing 29 to improve responsiveness of the sweep. The backup valve 93 has an inlet 99 that is connected to the water inlet hose 79. This hose 79 in turn is connected to the source of pressurized water 21.

The backup valve 93 is conventional and commercially available. The valve is used with other types of moving pool cleaning devices, such as bottom cleaners. In its operation, the backup valve 93 alternates between first and second stages. Pressurized water from the input hose 79 causes the valve to periodically change between the first and second stages. In the first stage, the backup valve 93 allows pressurized water to pass from the inlet hose 79 to both output hoses 15B, 17B. An equal amount of water is provided to the right and left nozzles on the sweep and the sweep 13 moves forward (see FIG. 9A). The sweep 13 drags the valve 93 behind it.

After some period of time has passed, the valve 93 changes to the second stage, wherein water from the input hose is vented directly into the pool, instead of to the output hoses. An opening 101 for venting water is on the outlet end of the valve 93. This venting pushes the valve 93 in a backward direction. The valve 93 drags the sweep 13 in a backward direction as well (see FIG. 9B). The opening 101 for venting water is located off of the center line of the valve. Thus, when the valve backs up, it does not backtrack in its forward path, but instead, moves to the side of its forward path. This has the effect of turning the sweep into a new heading.

Figures 9A, 9B, 9C:
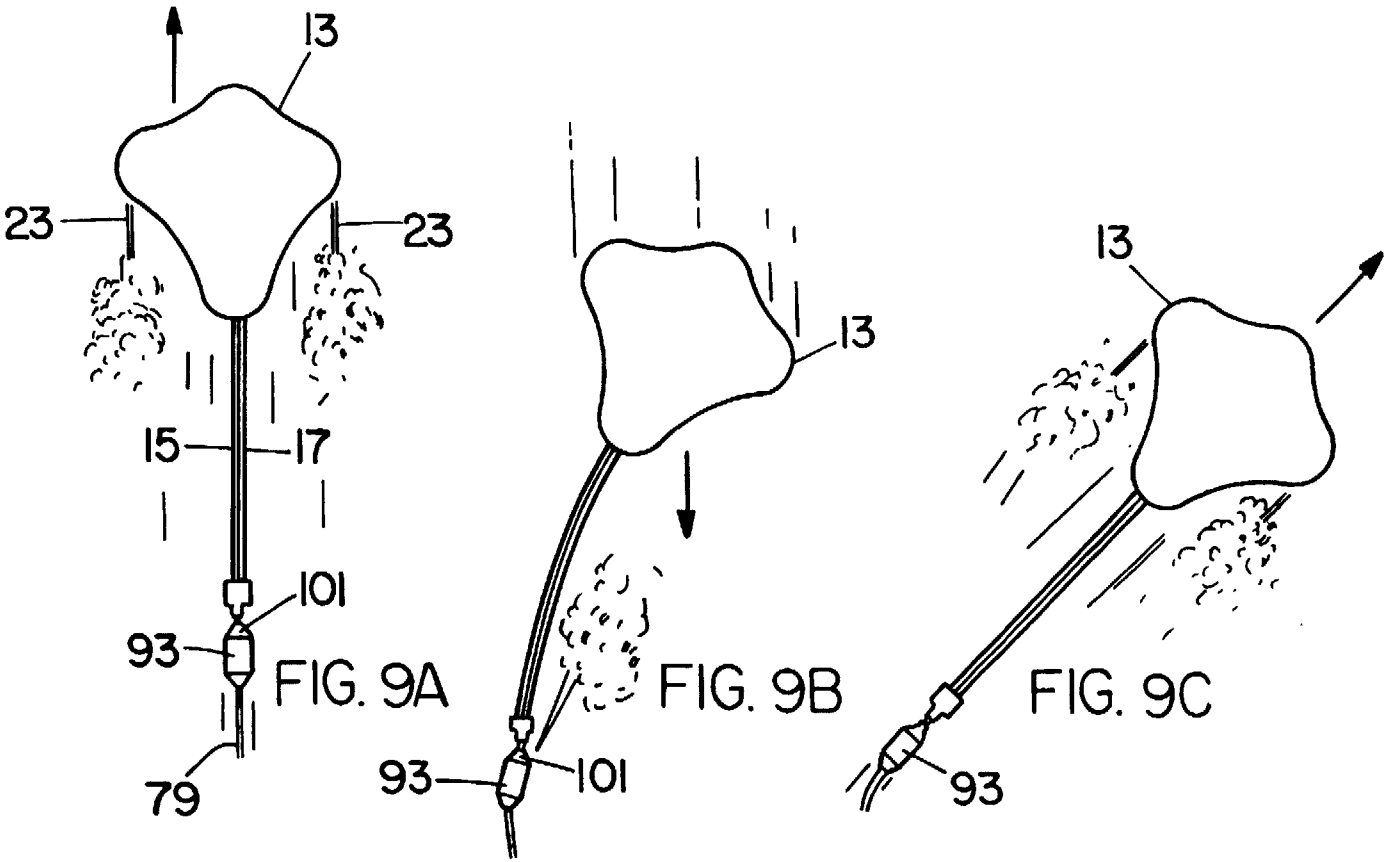
FIGS. 9A, 9B, and 9C illustrate the operation of the sweep system of FIG. 8.

After some more time has passed, the valve 93 changes back to the first stage, wherein the sweep moves forward along its new heading (see FIG. 9C). The valve 93 continues to alternate between the stages.

The sweeping effectiveness is based upon the cyclic forward and reverse motion created by the backup valve 93. The backup valve typically operates for a longer amount of time in the forward direction (first stage) than it does in the reverse direction (second stage). For example, the backup valve can operate one minute in the first stage and about 5–10 seconds in the second stage. The backup valve can be configured so as to be programmable. Thus, the amount of time spent in each stage can be set by an operator to accomodate pool size or personal choice.

It is desired to randomly change the direction of the sweep so that the sweep will traverse over the entire area of the pool surface at least once. For a typical residential pool (about 20 feet by 40 feet), the sweep will traverse the entire surface in about 2–3 hours.

Randomness in steering is obtained by the backup valve, water currents in the pool (which currents are created by the pool's filtration system and pump), wind that acts on the sweep itself, or collisions with the side walls of the pool and floating objects (such as a chemical feeder) in the pool. The rounded right and left sides 41 and rounded front end 43 facilitate deflections of the sweep off of the side walls of the pool. The sweep may even roll off of the walls. Alternatively, small wheels coupled to the sides of the housing can be used to assist the sweep in rolling off of the pool side walls. Such wheels (not shown) rotate about a respective vertical axis.

If the sweep becomes stuck in the corner, then the second stage of the backup valve will extract the sweep. The extracted sweep will then resume its forward direction on a new course or heading.

In FIG. 10 there is shown an extension 103 for assisting the sweep 13 in being deflected off of the side walls of a pool during automatic operation. One end 107 of the extension 103 is coupled to the front end 43 of the housing 29. A slot 109 is formed in the housing 29 for receiving, by way of an interference fit, the end 107 of the extension 103. The other end of the extension has a roller 111 coupled thereto. The roller 111 can rotate about a vertical axis.

Such an extension 103 is used if the sweep 13 frequently becomes trapped against the wall of the pool. Referring to FIG. 11A, as the sweep 13 moves forward, the roller 111 will contact the side wall 113 of the pool. The sweep 13 will pivot about the roller 111 (see FIG. 11B), either to the right or left side. (FIG. 11B shows the sweep pivoting to its left side.) The direction of pivoting depends on slight differences in thrust produced by the right and left nozzles, water currents, the angle that the extension makes with the wall, and wind. As the sweep pivots about the roller, the angle of the extension 103 relative to the pool side wall 13 will decrease such that the roller will be pushed along the wall. Forward motion is thus established, with the sweep sweeping against the wall (see FIG. 11C). Wind can congregate large amounts of debris along a particular side wall of the pool. The sweep 13 can clean this up as it moves along the wall.

The diameter of the roller 111 and the length of the extension 103 can be varied to obtain a suitable angle of "hug" along the side wall of the pool (as shown in FIG. 11C). This is the angle that the extension 103 forms with the pool's side wall 113 as the sweep moves along the side wall. A longer extension will decrease the angle. Also, a larger diameter roller will decrease the angle.

If the extension enters the wall skimmer in a pool (typically formed by an opening in the pool side wall), then the extension can be extracted when the backup valve provides backup thrust.

The foregoing disclosure and the showings made in the drawings are merely illustrative of the principles of this invention and are not to be interpreted in a limiting sense.

I claim:

1. A system for sweeping a surface of a body of water, comprising:

a) a sweep, said sweep comprising a basket having a front opening and a mesh that extends rearwardly from said front opening;

b) said sweep also comprising floats coupled to said basket, said floats having a buoyancy that positions said front opening of said basket both above and below said surface, wherein said basket is partially submerged in said water;

c) said sweep further comprising two nozzles coupled to said basket, each of said nozzles having an opening that faces rearwardly relative to said basket front opening, said nozzles being spaced apart from each other with said basket being located between said nozzles;

d) two conduits, each of which has first and second ends, with the first end of each of said conduits being connected to a respective one of said nozzles such that fluid provided by said conduits to said nozzles discharges through said nozzle openings;

e) a controller connected to the second ends of said conduits, said controller also connected to a pressurized supply of said fluid, said controller being operated so as to selectively control a flow of said pressurized fluid to each of said conduits, wherein said basket is propelled across said water in a steerable manner.

2. The system of claim 1 wherein said front opening of said basket has a pivotable trap door that opens to allow objects to enter said basket and closes to prevent said objects from exiting said basket.

3. The system of claim 1 wherein said floats comprise two lateral floats spaced apart from each other with said basket being located between said lateral floats, each of said nozzles being located in a respective one of said lateral floats.

4. The system of claim 1 wherein said floats comprise two lateral floats and a rear float, said lateral floats being spaced apart from each other with said basket being located between said lateral floats, said rear float being located rearwardly of said basket.

5. The system of claim 1 wherein said conduits are flexible and buoyant so as to float on said water.

6. The system of claim 1 wherein said sweep comprises a frame, said basket depends from said frame, said floats being coupled to said basket by way of said frame, said floats also depending from said frame, said frame being located above said surface of said body of water.

7. The system of claim 6 wherein said frame has a rounded front end and rounded sides.

8. A system for sweeping a surface of a body of water, comprising:

a) a sweep, said sweep comprising a basket having a front opening and a mesh that extends rearwardly from said front opening;

b) said sweep also comprising floats coupled to said basket, said floats having a buoyancy that positions said front opening of said basket both above and below said surface, wherein said basket is partially submerged in said water;

c) said sweep further comprising two nozzles coupled to said basket, each of said nozzles having an opening that faces rearwardly relative to said basket front opening, said nozzles being spaced apart from each other with said basket being located between said nozzles;

d) two conduits, each of which has first and second ends, with the first end of each of said conduits being connected to a respective one of said nozzles such that fluid provided by said conduits to said nozzles discharges through said nozzle opening;

e) a backup valve connected to the second end of the said conduits, said backup valve being located rearwardly of said basket, said backup valve alternating operation between a first stage, wherein pressurized fluid is passed through said backup valve to said conduits, and a second stage, wherein pressurized fluid is exhausted out of an end of said backup valve that faces said basket.

9. The system of claim 8 further comprising an elongated extension, said extension having two ends, one end of said extension being coupled to said basket, the other end of said extension having a roller thereon, said roller rotating about a vertical axis with respect to said surface of said water.

10. The system of claim 8 wherein said front opening of said basket has a pivotable trap door that opens to allow objects to enter said basket and closes to prevent said objects from exiting said basket.

* * * * *